US008042843B2

(12) United States Patent
Tien

(10) Patent No.: US 8,042,843 B2
(45) Date of Patent: Oct. 25, 2011

(54) ADJUSTABLE DRIVING MECHANISM FOR PANIC DOOR LOCK

(75) Inventor: Hung-Jen Tien, Tainan (TW)

(73) Assignee: I-Tek Metal MFG. Co., Ltd., Tainan (TW)

( * ) Notice: Subject to any disclaimer, the term of this patent is extended or adjusted under 35 U.S.C. 154(b) by 852 days.

(21) Appl. No.: 12/109,395

(22) Filed: Apr. 25, 2008

(65) Prior Publication Data

US 2009/0266120 A1 Oct. 29, 2009

(51) Int. Cl.
*E05B 65/10* (2006.01)
*E05B 65/00* (2006.01)

(52) U.S. Cl. ..... 292/92; 292/93; 292/DIG. 60

(58) Field of Classification Search ..... 292/92–94, 292/163, 166, 169, 170, DIG. 60
See application file for complete search history.

(56) References Cited

U.S. PATENT DOCUMENTS

| | | | | | |
|---|---|---|---|---|---|
| 222,907 | A * | 12/1879 | Holmes | 292/166 |
| 461,350 | A * | 10/1891 | Lincoln | 70/129 |
| 1,490,777 | A * | 4/1924 | La Fortune | 292/166 |
| 2,547,546 | A * | 4/1951 | Stulpin et al. | 292/166 |
| 2,715,542 | A * | 8/1955 | Gould | 292/341.15 |
| 3,633,953 | A * | 1/1972 | Gley | 292/166 |
| 4,007,954 | A * | 2/1977 | Erickson | 292/165 |
| 4,243,256 | A * | 1/1981 | Frydrych | 292/245 |
| 4,796,931 | A * | 1/1989 | Heid | 292/92 |
| 5,085,474 | A * | 2/1992 | Toledo et al. | 292/92 |
| 5,947,534 | A * | 9/1999 | Zarzycki, Jr. | 292/92 |
| 6,557,909 | B2 * | 5/2003 | Morris | 292/169.15 |
| 7,144,050 | B2 * | 12/2006 | Lin | 292/93 |
| 7,748,757 | B2 * | 7/2010 | Shen | 292/92 |
| 2010/0117376 | A1 * | 5/2010 | Shen | 292/92 |

FOREIGN PATENT DOCUMENTS

| | | | |
|---|---|---|---|
| JP | 52051300 | A * | 4/1977 |
| JP | 03122386 | A * | 5/1991 |

* cited by examiner

*Primary Examiner* — Carlos Lugo
(74) *Attorney, Agent, or Firm* — Alan Kamrath; Kamrath & Associates PA

(57) ABSTRACT

A door lock includes a bracket fixed to a door. A linking rod is slideably mounted to the bracket and includes a slot. A draw member includes a first end pivotably connected to the bracket and a second end operably connected to a retractor. The draw member further includes a guide slot. A pin slideably extends through the slot and the guide slot such that the movement of the linking rod causes pivotal movement of the draw member, which in turn, urges the retractor to move a latch bolt from an extended position to a retracted position. A follower is coupled to the pin to move therewith. An adjusting member is in threading connection with the follower and rotatable to move the follower and the pin relative to the linking rod to adjust a position of the second end of the draw member relative to the retractor.

14 Claims, 9 Drawing Sheets

ADJUSTABLE DRIVING MECHANISM FOR PANIC DOOR LOCK

BACKGROUND OF THE INVENTION

The present invention relates to a driving mechanism for a door lock and, more particularly, to an adjustable driving mechanism for a panic door lock.

A typical panic door lock mounted to a panic door includes a press bar mounted to a side of the panic door and a lock body inside the panic door. The lock body includes a latch bolt movable between an extended, latching position and a retracted, unlatching position and a retractor for moving the latch bolt from the extended position to the retracted position. A driving mechanism is operably connected between the latch bolt and the press bar. The driving mechanism includes a draw member abutting the retractor. When the press bar is pressed, the draw bar urges the retractor to move, causing retraction of the latch bolt. However, in a case that the driving mechanism is installed in a position such that a spacing exists between the draw member and the retractor, the draw member travel idly through the spacing without moving the retractor when the press bar is pressed. As a result, the latch bolt can not move to its fully retracted, unlatching position, adversely affecting operation of the door and requiring troublesome reinstallation of the driving mechanism.

A need exists for an adjustable driving mechanism for a panic door lock such that the position of the draw member relative to the retractor can be adjusted to avoid troublesome reinstallation of the driving mechanism.

BRIEF SUMMARY OF THE INVENTION

The present invention solves this need and other problems in the field of panic door locks by providing, in a preferred form, a door lock including a case adapted to be mounted in a door and a bracket adapted to be fixed to the door. A latch bolt is movable between a retracted position inside the case and an extended position outside the case. A retractor is mounted in the case and operably connected to the latch bolt for moving the latch bolt from the extended position to the retracted position. A linking rod is slideably mounted to the bracket and includes first and second ends spaced from each other along a longitudinal axis of the linking rod. The second end of the linking rod is adapted to be operably connected to an operative member mounted to the door such that operation of the operative member causes movement of the linking rod along the longitudinal axis. The linking rod further includes a slot extending between the first and second ends along the longitudinal axis of the linking rod. A draw member includes a first end pivotably connected to the bracket about a pivot axis and a second end operably connected to the retractor. The draw member further includes an intermediate portion between the first and second ends and having a guide slot. A pin is slideably extended through the slot of the linking rod and the guide slot of the draw member such that the movement of the linking rod causes pivotal movement of the draw member about the pivot axis, which in turn, causes movement of the retractor to move the latch bolt from the extended position to the retracted position. A follower is coupled to the pin to move therewith. An adjusting member is in threading connection with the follower and rotatable to move the follower and the pin relative to the linking rod to adjust a position of the second end of the draw member relative to the retractor. Thus, even the draw member is mounted in a position in which a spacing exists between its second end and the retractor, such a spacing can be eliminated by rotating the adjusting member.

In the most preferred form, the first end of the linking rod includes parallel, spaced first and second beams extending parallel to and on opposite sides of the longitudinal axis of the linking rod. The beams include aligned slots through which the pin extends. The first end of the linking rod further includes a plate interconnected between the first and second beams and perpendicular to the longitudinal axis of the linking rod. The plate has a hole and a plurality of angularly spaced positioning holes. The follower includes a follower body having a pin hole extending perpendicularly to the longitudinal axis of the linking rod. The pin extends through the pin hole of the follower body. The follower further includes an extension extending from the follower body along the longitudinal axis of the linking rod. The extension has a screw hole. The adjusting member includes a head and a threaded shank extending from an inner side of the head through the hole of the plate into the screw hole of the extension such that rotation of the threaded shank causes movement of the follower along the longitudinal axis of the linking rod and movement of the pin along the guide slot of the draw member to adjust the position of the second end of the draw member relative to the retractor. A plurality of angularly spaced protrusions is formed on the inner side of the head and releasably engaged with the positioning holes to position the adjusting member relative to the follower. The head of the adjusting member is adapted to be driven by a tool to rotate the threaded shank. A spring is mounted around the extension of the follower and between the follower body and the plate. The spring biases the follower away from the plate and biases the protrusions to engage with the positioning holes. The protrusions are disengaged from the positioning holes when a rotational force is applied to the head and compresses the spring.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
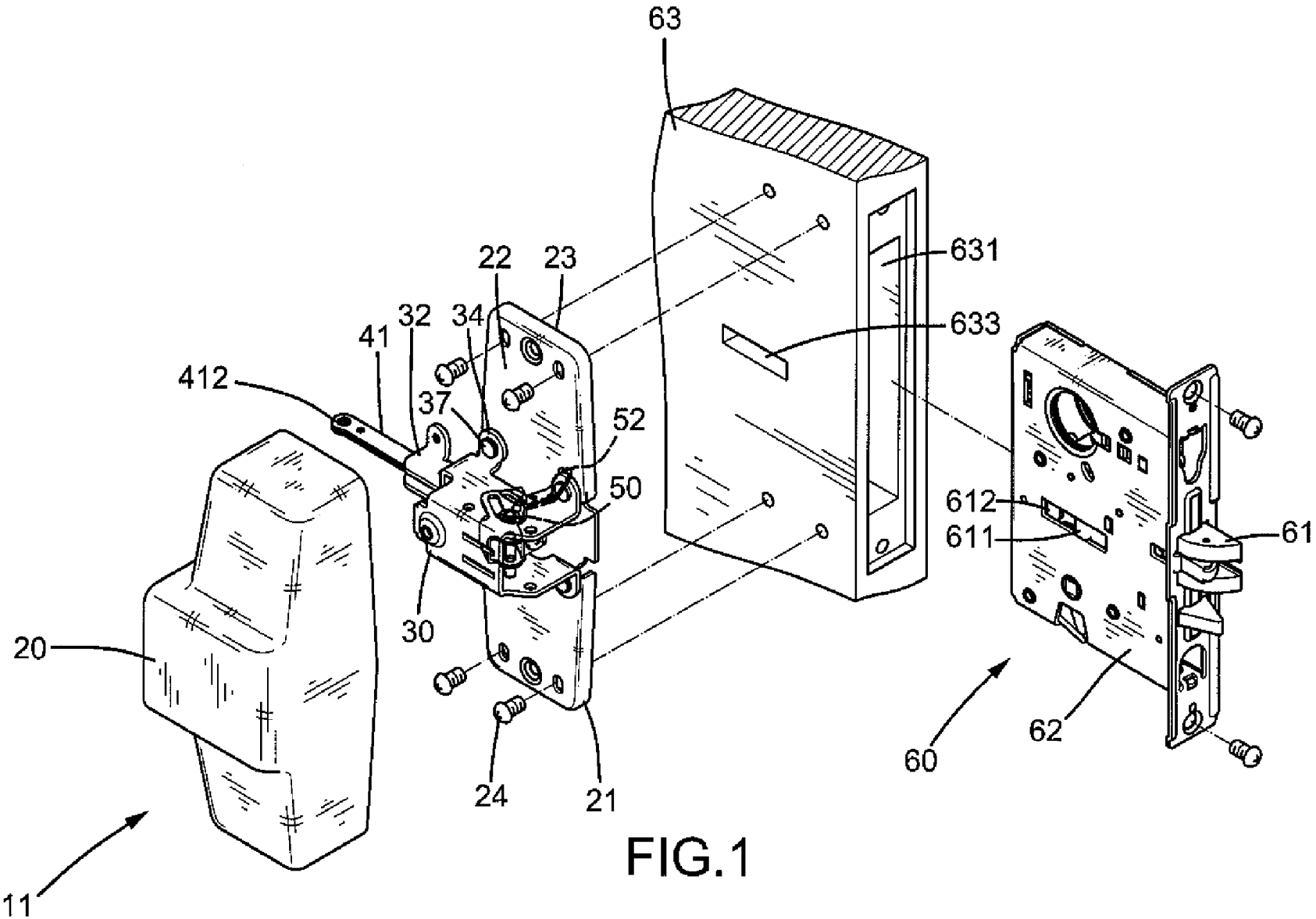
FIG. 1 shows a diagrammatic exploded, perspective view of a panic door and a door lock utilizing an adjustable driving mechanism according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "side", "end", "portion", "section", "longitudinal", "angular", "inner", "outer", "spacing", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An adjustable driving mechanism according to the preferred teachings of the present invention is shown in the drawings and generally designated 11. According to the preferred form shown, adjustable driving mechanism 11 is utilized with a panic door lock 1 mounted to a panic door 63 having a compartment 631 for receiving a lock body 60 of door lock 1. Door 63 has an opening 633 in an inner side thereof and in communication with the compartment 631. Lock body 60 includes a case 62 having a slot 612 in a side thereof and aligned with opening 633. Lock body 60 further includes a latch bolt 61 movable between a retracted position inside case 62 and an extended position outside case 62. Furthermore, lock body 60 includes a retractor 611 mounted in case 62 for moving latch bolt 61 from the extended position to the retracted position. Latch bolt 61 is normally biased to the extended position, and a locking effect is provided when latch bolt 61 in the extended position is received in a side frame 632 of door 63. A spring 68 is attached to latch bolt 61 for returning purposes. A lock core 621 is mounted to an outer side of door 63 and operably connected to retractor 611. A key can be inserted into lock core 621 and turned to move retractor 611 for retracting latch bolt 61.

According to the preferred form shown, door lock 1 utilizing adjustable driving mechanism 11 according to the preferred teachings of the present invention further includes an inner operating device 10 having a linking mechanism 12 and operable to retract latch bolt 61 via retractor 611. Liking mechanism 12 can be of any desired form as conventional including but not limited to of a commercially available type. According to the preferred form shown, linking mechanism 12 includes a housing 122 and an operative member 121 in the most preferred form shown as a press bar pivotably coupled to housing 122. A rocker 124 is mounted in housing 122 and includes a first corner 125 pivotably connected to operative member 121, a second corner 126 pivotably connected to driving mechanism 11, and a third corner 127 pivotably connected to housing 122. When operative member 121 is operated (e.g., pressed), rocker 124 pivots about third corner 127 to drive driving mechanism 11 for retracting latch bolt 61.

According to the preferred form shown, driving mechanism 11 includes a base 21 fixed by fasteners 24 to the inner side of door 63. Base 21 includes opposite first and second sides 22 and 23 and a through-hole 222 extending from first side 22 through second side 23 and aligned with opening 633 of door 63. Base 21 further includes a plurality of fixing holes 221.

Figure 5:
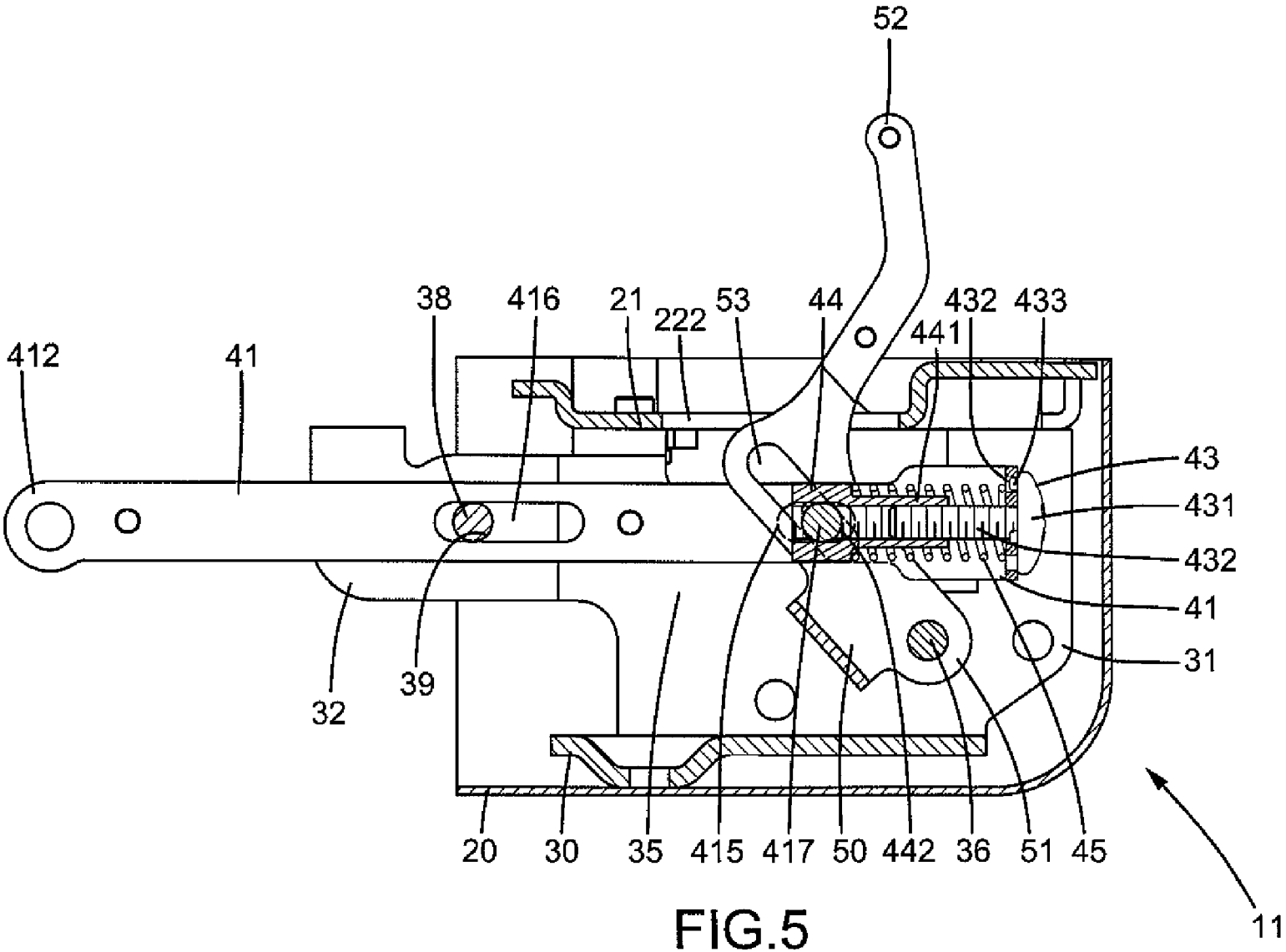
FIG. 5 shows a cross-sectional view of the driving mechanism of FIG. 1.

According to the preferred form shown, driving mechanism 11 further includes a bracket 30 fixed by fasteners 37 to base 21. Bracket 30 is substantially U-shaped and includes parallel, spaced first and second sidewalls 33 and an interconnecting wall 48 interconnected between first and second sidewalls 33, defining a space 35 therebetween. Each of first and second sidewalls 33 includes a plurality of engaging portions 34 through which fasteners 37 are extended to into fixing holes 221 of base 21. First and second sidewalls 33 include aligned pin holes 331 in a section 31 thereof and aligned holes 39 (FIG. 5) in another section 32 thereof.

According to the preferred form shown, driving mechanism 11 further includes a linking rod 41 movably extending between first and second sidewalls 33 of bracket 30. Linking rod 41 includes first and second ends 411 and 412 spaced from each other along a longitudinal axis of linking rod 41. Second end 412 is pivotably connected to second corner 126 of rocker 124 such that operation of operative member 121 causes movement of linking rod 41 relative to bracket 30 along the longitudinal axis. A limiting slot 416 is formed between first and second ends 411 and 412 of linking rod 41 and has a length larger than the diameter of holes 39 of bracket 30. A pin 38 is extended through holes 39 of bracket 30 and limiting slot 416 so that two ends of limiting slot 416 limit movement of pin 38 to limit movement of linking rod 41 relative to bracket 30. According to the most preferred form shown, first end 411 of linking rod 41 includes parallel, spaced first and second beams 420 extending parallel to and on opposite sides of the longitudinal axis of linking rod 41. First and second beams 420 include aligned slots 415 extending along the longitudinal axis of linking rod 41. Furthermore, first and second beams 420 are slideably received between sidewalls 33 of bracket 30. First end 411 of linking rod 41 further includes a plate 422 interconnected between first and second beams 420 and perpendicular to the longitudinal axis of linking rod 41. Plate 422 has a hole 413 and a plurality of angularly spaced positioning holes 414 surrounding hole 413.

According to the preferred form shown, driving mechanism 11 further includes a follower 44 movably received between first and second beams 420 of linking rod 41. Follower 44 includes a follower body 440 having a pin hole 442 extending perpendicularly to the longitudinal axis of linking plate 40. An extension 443 extends from a side of follower body 440 along the longitudinal axis of linking plate 40 and has a screw hole 443.

Figure 4:
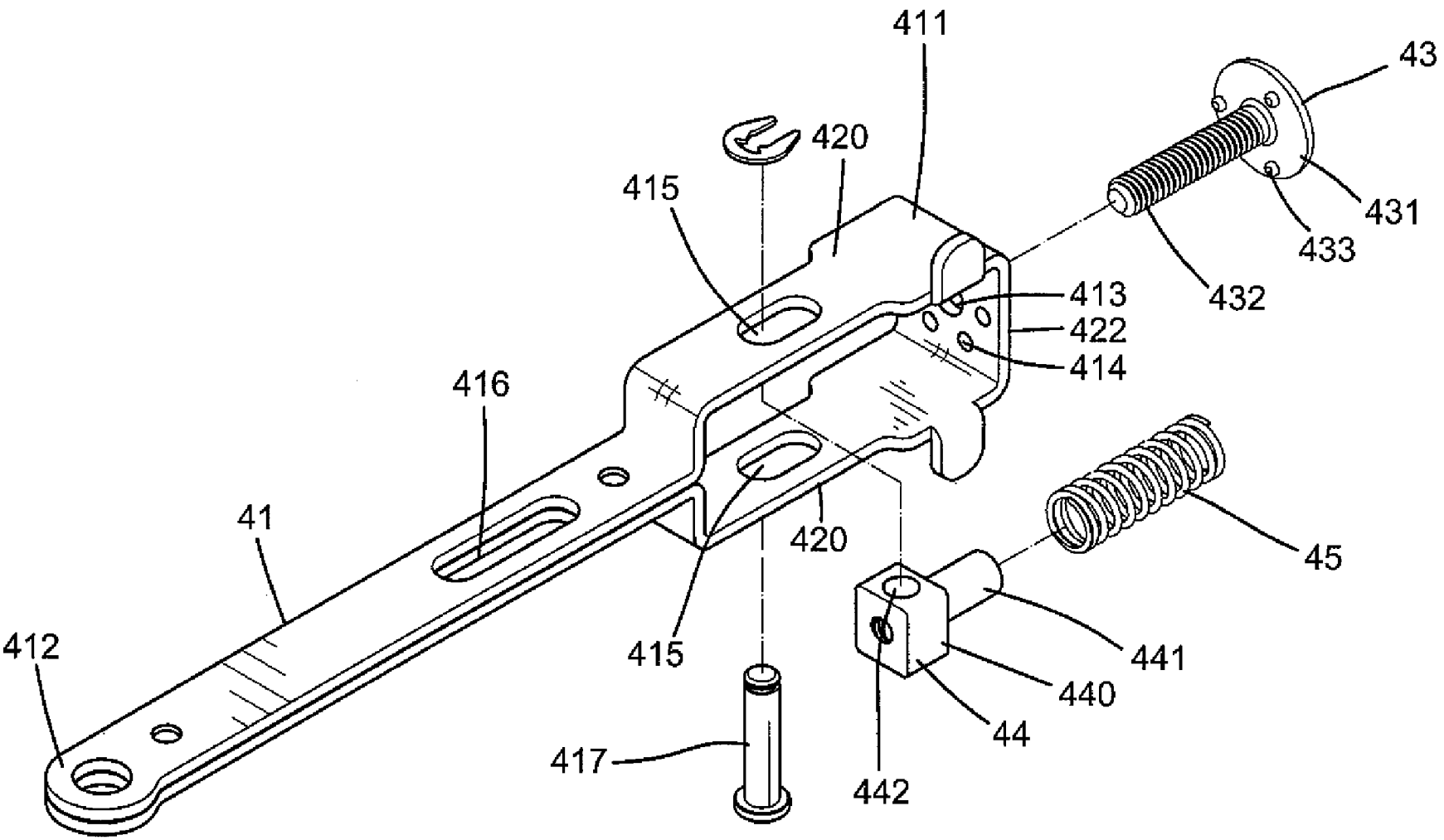
FIG. 4 shows an exploded, perspective view of a linking rod, a follower, and an adjusting member of the driving mechanism of FIG. 1.

According to the preferred form shown, driving mechanism 11 further includes an adjusting member 43 shown in the most preferred form of a screw including a head 431 and a threaded shank 432 extending from an inner side of head 431. A plurality of angularly spaced protrusions 433 (FIG. 4) is formed on the inner side of head 431. Threaded shank 432 is extended through hole 413 of plate 422, with protrusions 433 releasably engaged with positioning holes 414 of plate 422. The number of protrusions 433 can be the same as or less than that of positioning holes 414. A spring 45 is mounted around extension 441 of follower 44 and between follower body 440 and plate 422. Spring 45 biases follower 44 away from plate 422 and biases protrusions 433 to engage with positioning holes 414. Head 431 of adjusting member 43 can be turned by a tool such as a screw driver to impart a rotational force to head 431. When the rotational force overcomes and compresses spring 45, protrusions 433 are disengaged from positioning holes 414 to allow rotational movement of threaded shank 432, which in turn, causes movement of follower 44 along the longitudinal axis of linking rod 41. It can be appreciated that protrusions 433 have a length and a smooth outer periphery to allow smooth disengagement from positioning holes 414 of plate 422 when head 431 is rotated.

Figure 2:
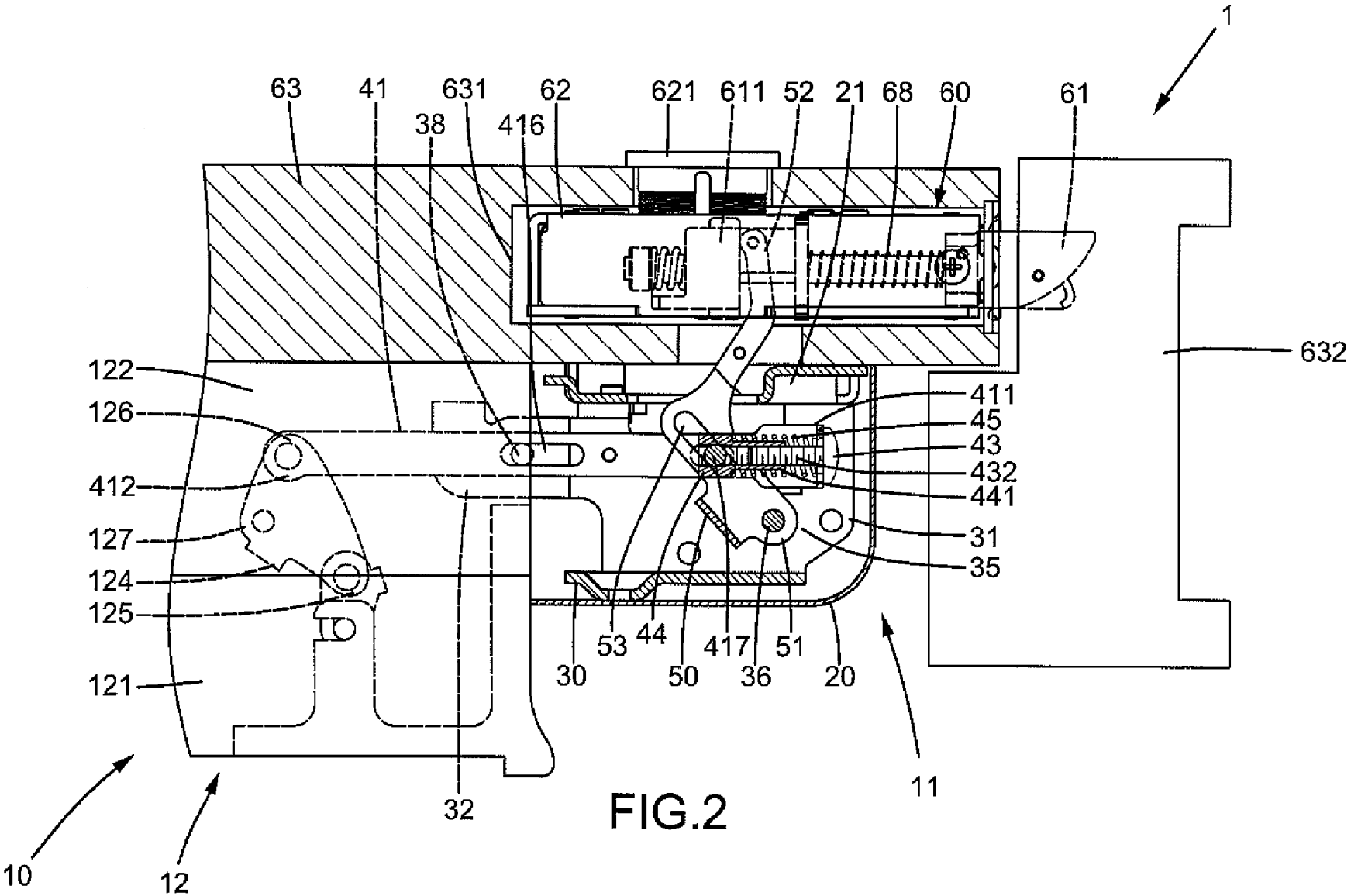
FIG. 2 shows a partial, cross-sectional view of the panic door lock of FIG. 1 with a latch bolt in an extended position.
Figure 3:
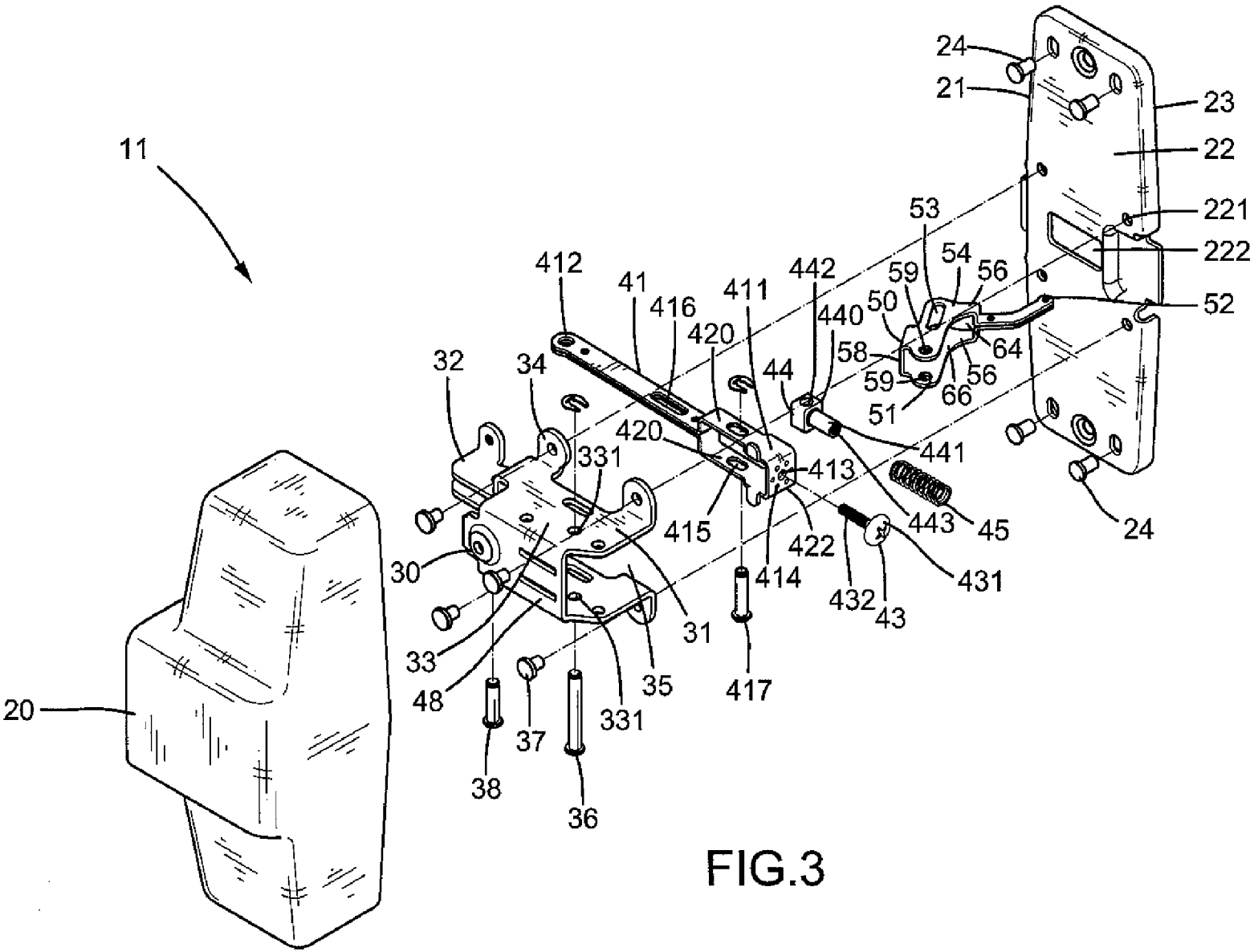
FIG. 3 shows a partial, exploded, perspective view of the driving mechanism of FIG. 1.
Figure 6:
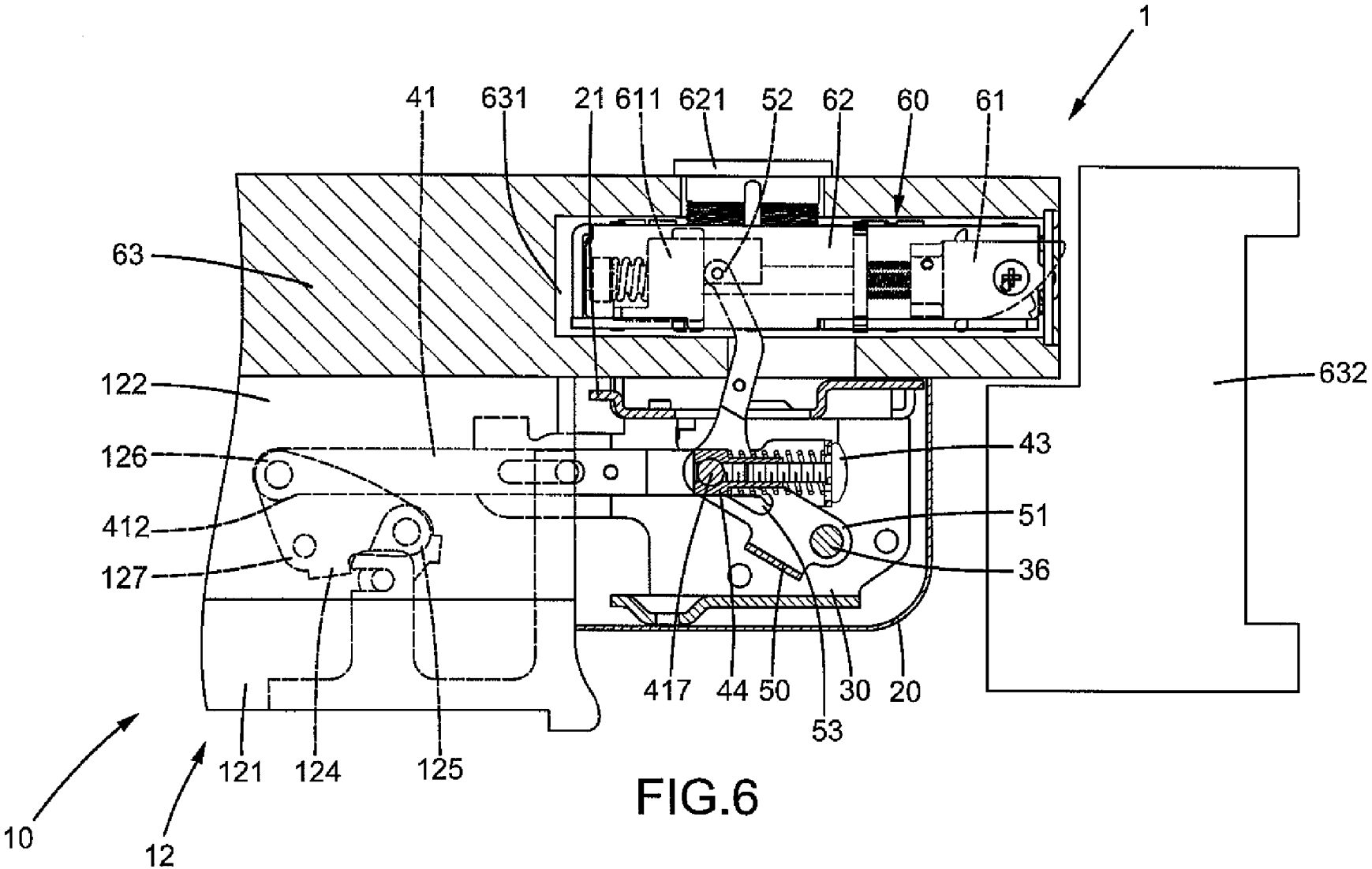
FIG. 6 shows a partial, cross-sectional view of the panic door lock of FIG. 1 with the latch bolt in a retracted position.

According to the preferred form shown, driving mechanism 11 further includes a draw member 50 having first and second ends 51 and 52 and an intermediate portion 54 between first and second ends 51 and 52. According to the most preferred form shown, first end 51 and intermediate portion 54 of draw member 50 are substantially U-shaped and include parallel, spaced first and second side plates 56 and an interconnecting plate 58 interconnected between first and second side plates 56, forming opposite first and second openings 64 and 66 extending between first and second side plates 56. First and second side plates 56 include aligned guide slots 53. Extension 441 of follower 44 extends through opening 66 of draw member 50. Furthermore, follower 44 is movably received between first and second side plates 56, which in turn, are movably received between side beams 420 of linking rod 41. Second end 52 of draw member 50 is slideably extended through through-hole 222 of base 21, opening 633 of door 63, and slot 612 of case 62 and abuts against retractor 611. A pin 36 is extended through pin holes 331 of bracket 30 and pin holes 59 of draw member 50 to pivotably connect draw member 50 to bracket 30. Another pin 417 is slideably extended through slots 415 of linking rod 41, pin hole 442, of follower 44, and guide slots 53 of draw member 50. Thus, operation of operative member 121 causes movement of linking rod 41 and pin 417. Pin 417 slides in guide slots 513 to cause pivotal movement of draw member 50 about a pivot axis defined by pin 36. As a result, second end 52 of draw member 50 presses against retractor 611 and urges retractor 611 to move inward to retract latch bolt 61 (see FIG. 6). Guide slots 53 are elongated to avoid interference between drive member 50 and pin 417. Latch bolt 61 returns to its extended position (see FIG. 2) under action of spring 68 when operative member 121 is released. A cover 20 is mounted to base 21 to cover the whole driving mechanism 11. It can be appreciated that opening 64 of draw member 50 allows free movement of follower 44 (see FIG. 6).

Figure 7:
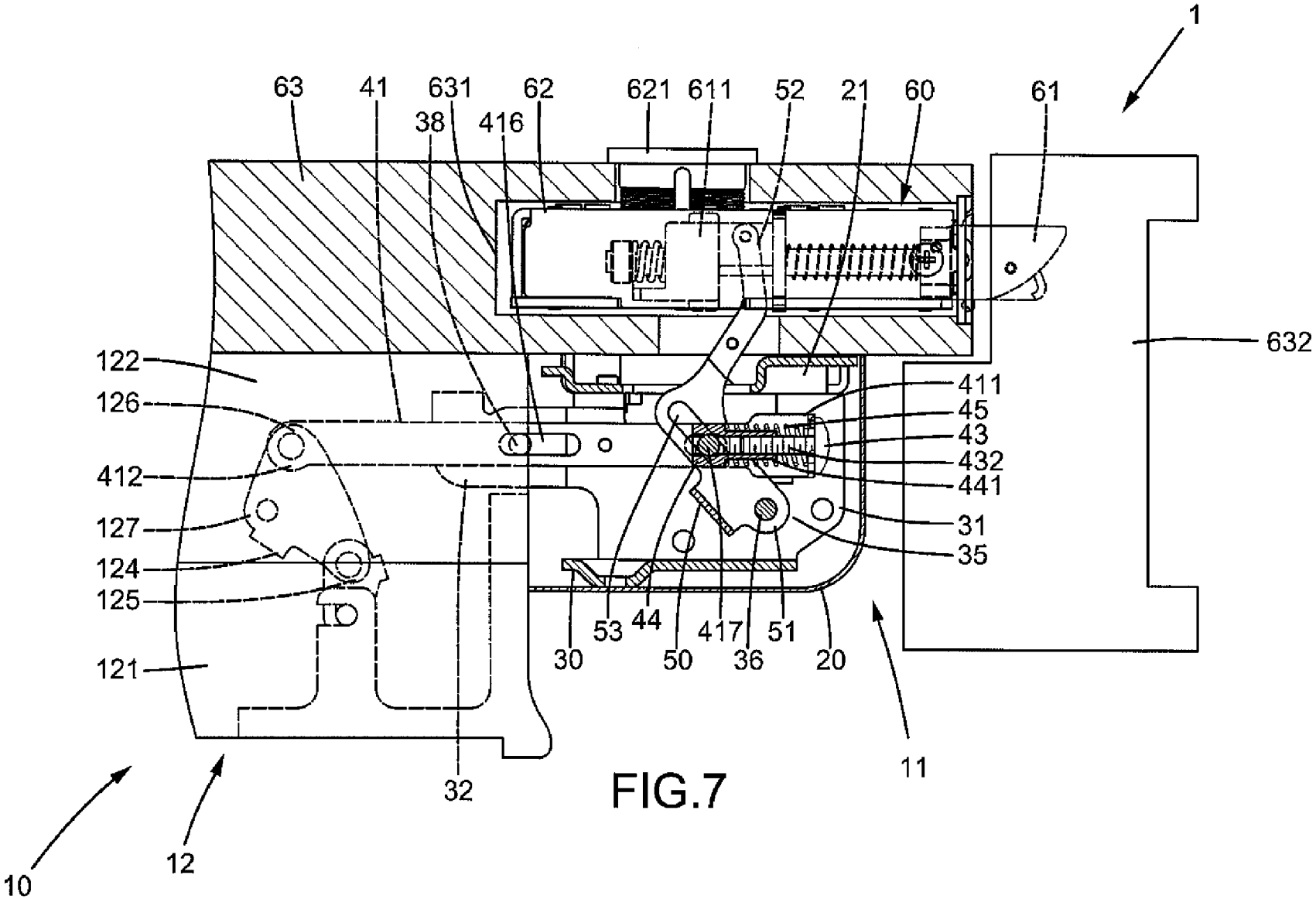
FIG. 7 shows a partial, cross-sectional view of the panic door lock of FIG. 1 with the driving mechanism installed in a position closer to a side frame and with the latch bolt in an extended position.
Figure 8:
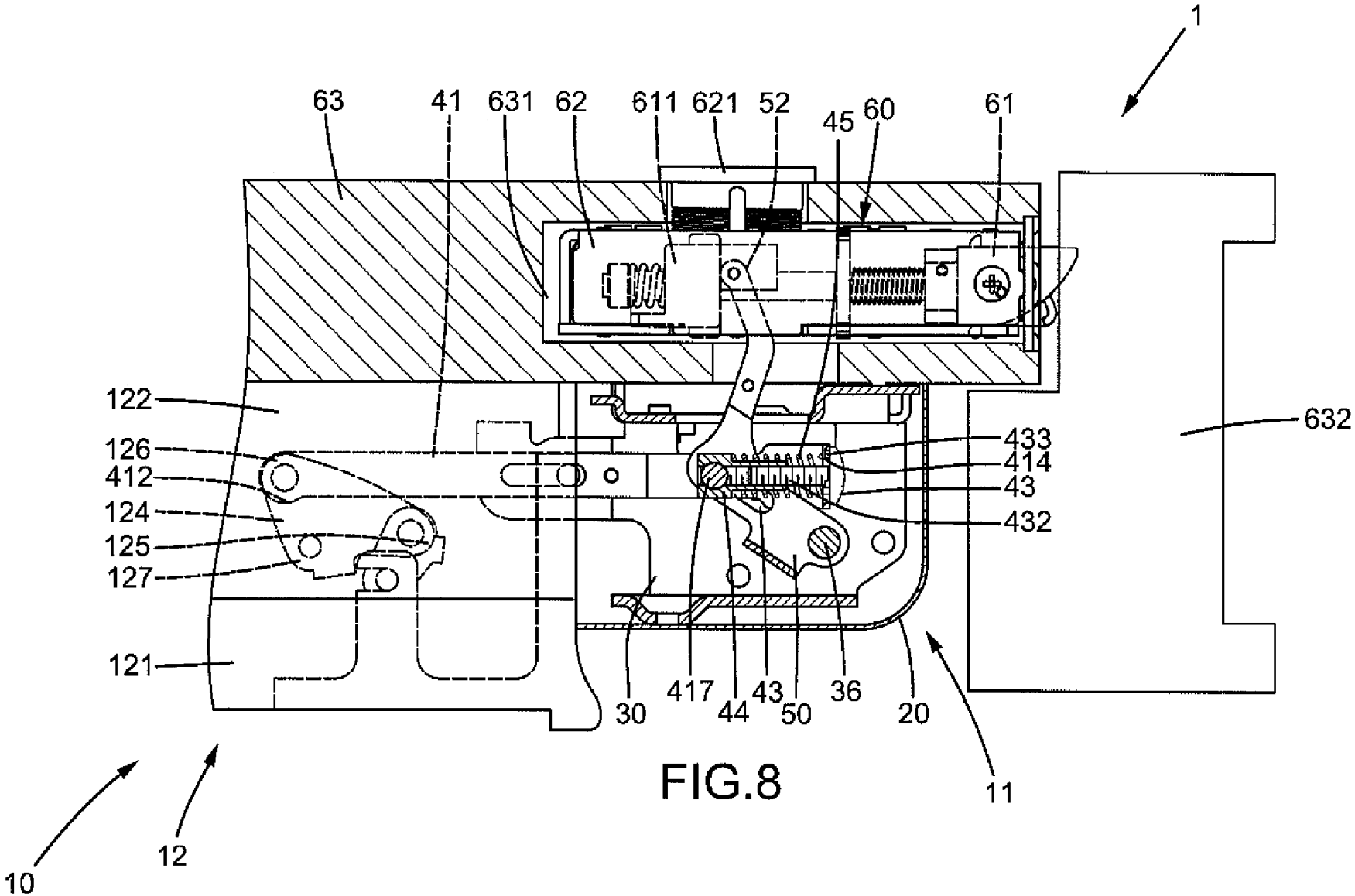
FIG. 8 shows a partial, cross-sectional view of the panic door lock of FIG. 7 with the latch bolt in a retracted position.

However, in a case that the driving mechanism 11 is mounted in a position too close to side frame 632 (see FIG. 7), a spacing exists between second end 52 of draw member 50 and retractor 611 such that, when operative member 121 is operated, draw member 50 has an idle travel before its second end 52 comes in contact with retractor 611. Thus, latch bolt 61 can not be moved to its fully retracted position inside case 62, failing to unlatch door 63 (see FIG. 8).

Figure 9:
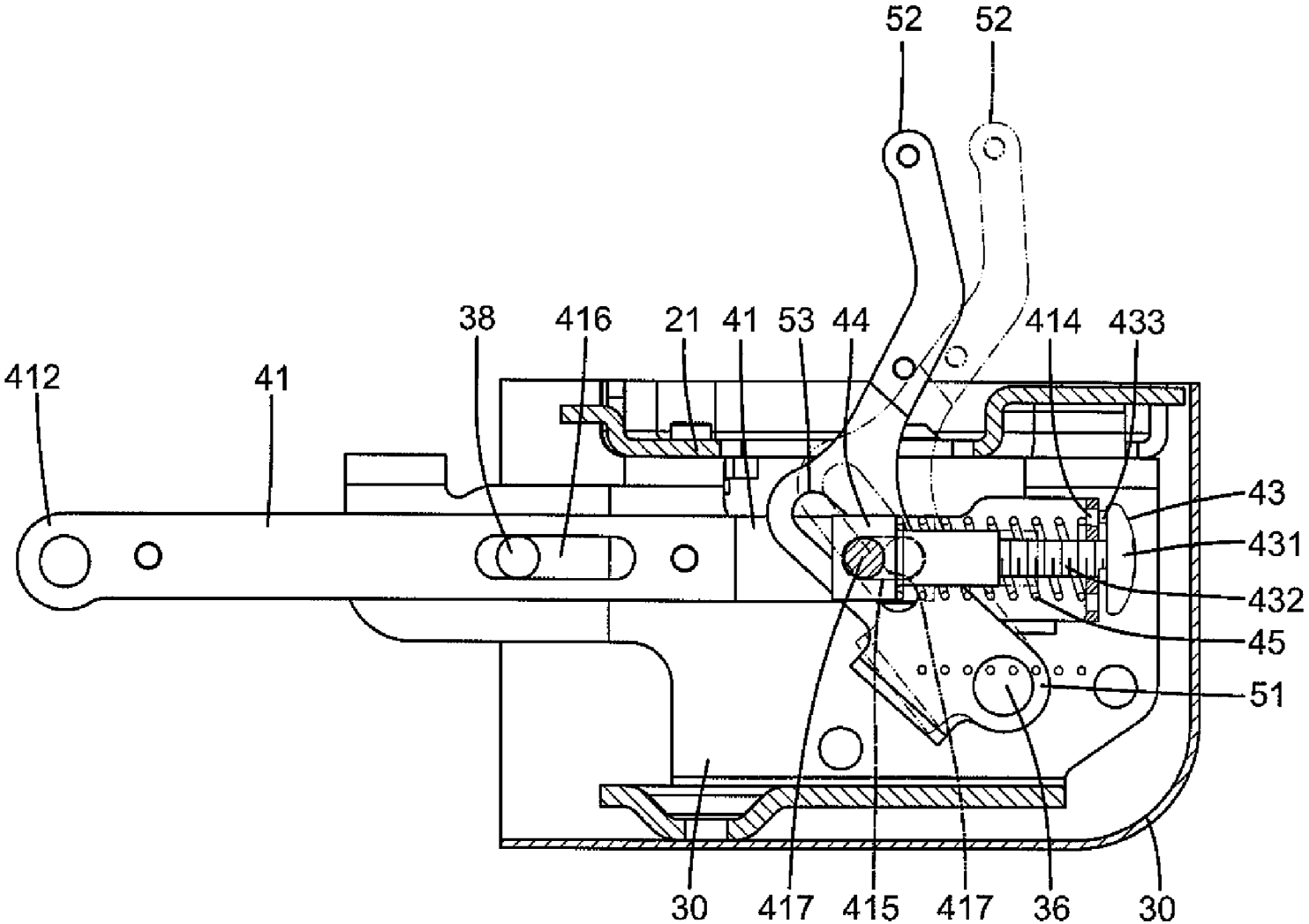
FIG. 9 shows a cross-sectional view of the driving mechanism of FIG. 7, illustrating adjustment of the driving mechanism.

In this case, as mentioned above, head 431 of adjusting member 43 can be turned by a tool to impart a rotational force to head 431. When the rotational force compresses spring 45, protrusions 433 are disengaged from positioning holes 414 to allow rotational movement of threaded shank 432, which in turn, causes movement of follower 44 and pin 417 along the longitudinal axis of linking rod 41. Slots 415 are elongated to allow movement of pin 417 along the longitudinal axis of linking rod 41. Pin 417 also moves along guide slots 53 of draw member 50 and causes pivotal movement of draw member 50 about the pivot axis defined by pin 36 until second end 52 of draw member 50 abuts against retractor 611 (see FIG. 9). Thus, the idle travel of draw member 50 is eliminated. Namely, latch bolt 61 can be effectively retracted when operative member 121 is operated. Reinstallation of driving mechanism 11 is, thus, not required.

Now that the basic teachings of the present invention have been explained, many extensions and variations will be obvious to one having ordinary skill in the art. For example, base 21 can be omitted, and bracket 30 can be directly mounted to door 63. Furthermore, bracket 30, linking rod 41, and draw member 50 can have other forms instead of U-shaped structures. As an example, bracket 30 can be in the form of a flat sheet having a hole 39 for receiving pin 38 and another hole 331 for receiving pin 36. Similarly, first end 411 of linking rod 41 can be in the form of a flat sheet having a single slot 415 for slideably receiving pin 417. Similarly, first end 51 and intermediate portion 54 of draw member 50 can be in the form of a flat sheet having a single hole 59 for receiving pin 36 and a single guide slot 53 for slideably receiving pin 417. Furthermore, adjusting member 43 can include only one protrusion 433 for positioning the adjusting member 43, although more protrusions 433 provide a more reliable positioning effect. Further, spring 45, positioning holes 414 of plate 422, and protrusions 433 of adjusting member 43 can be omitted, and hole 413 can include threading to allow free rotation of adjusting member 43 relative to plate 422 to move follower 44 along the longitudinal axis of linking rod 41, achieving the same adjusting effect. Further, adjusting member 43 can be in the form of a bolt having a hexagonal head with or without protrusions 433. Further, driving mechanism 11 according to the preferred teachings of the present invention can be utilized with door locks of other forms. For example, operative member 121 can be replaced with other functionally equivalent members for moving inking rod 41 for the purposes of retracting latch bolt 61. Further, lock core 621 can be replaced with another operative member operably connected to retractor 611 or linking rod 41.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A door lock comprising:

a case adapted to be mounted in a door;

a latch bolt movable between a retracted position inside the case and an extended position outside the case, with the latch bolt in the extended position being adapted to be received in a side frame of the door to lock the door lock, with the lock in the retracted position being disengaged from the side frame of the door to unlock the door;

a retractor mounted in the case and operably connected to the latch bolt for moving the latch bolt from the extended position to the retracted position;

a bracket adapted to be fixed to the door;

a linking rod slideably mounted to the bracket and including a longitudinal axis and a first end, with the linking rod further including a second end spaced from the first end along the longitudinal axis and adapted to be operably connected to an operative member mounted to the door such that operation of the operative member causes movement of the linking rod along the longitudinal axis, with the linking rod further including a slot extending between the first and second ends of the linking rod along the longitudinal axis of the linking rod;

a draw member including a first end pivotably connected to the bracket about a pivot axis and a second end operably connected to the retractor, with the draw member further including an intermediate portion between the first and second ends of the draw member, with the intermediate portion having a guide slot;

a pin slideably extending through the slot of the linking rod and the guide slot of the draw member such that movement of the linking rod along the longitudinal axis causes pivotal movement of the draw member about the pivot axis, which in turn, causes movement of the retractor to move the latch bolt from the extended position to the retracted position;

a follower coupled to the pin to move therewith; and an adjusting member in threading connection with the follower, with the adjusting member being rotatable to move the follower and the pin relative to the linking rod along the longitudinal axis and to move the pin along the guide slot, adjusting a position of the second end of the draw member relative to the retractor such that the latch is moved to the retracted position when the operative member is operated.

2. The door lock as claimed in claim 1, with the ease including another slot in a side thereof, with the door including an opening aligned with the other slot, with the door lock further comprising, in combination: a base adapted to be fixed to a side of the door, with the base including a through-hole adapted to be aligned with the opening of the door, with the bracket being fixed to the base, and with the second end of the draw member slideably extending through the through-hole of the base, the opening of the door, and the other slot of the case.

3. The door lock as claimed in claim 1, with the first end of the linking rod including a plate extending perpendicularly to the longitudinal axis of the linking rod and having a hole, with the follower including a follower body having a pin hole through which the pin extends, with the follower further including an extension extending from the follower body along the longitudinal axis of the linking rod, with the extension having a screw hole, with the adjusting member including a threaded shank extending through the hole of the plate into the screw hole of the extension such that rotation of the threaded shank causes movement of the follower and the pin along the longitudinal axis of the linking rod to adjust the position of the second end of the draw member relative to the retractor.

4. The door lock as claimed in claim 3, with the plate further including a plurality of angularly spaced positioning holes surrounding the hole of the plate, with the adjusting member including a head having an inner side from which the threaded shank extends, with the inner side of the head including a plurality of angularly spaced protrusions releasably engaged with the plurality of positioning holes to position the adjusting member relative to the follower, and with the head of the adjusting member being adapted to be driven by a tool to rotate the threaded shank.

5. The door lock as claimed in claim 4, further comprising, in combination: a spring mounted around the extension of the follower and between the follower body and the plate, with the spring biasing the follower away from the plate and biasing the plurality of protrusions to engage with the plurality of positioning holes, and with the protrusions being disengaged from the plurality of positioning holes when a rotational force is applied to the head and compresses the spring.

6. The door lock as claimed in claim 1, with the bracket including a hole, with the linking rod including a limiting slot aligned with the hole, with the door lock further comprising, in combination: another pin extending through the hole of the bracket and the limiting slot of the linking rod, and with the limiting slot including two ends limiting movement of the other pin to limit movement of the linking rod relative to the bracket.

7. The door lock as claimed in claim 1, with the bracket being U-shaped and including parallel, spaced first and second sidewalls) and an interconnecting wall interconnected between the first and second sidewalls, with the linking rod movably extending between the first and second sidewalls of the bracket, with the first and second sidewalls including aligned first pin holes, with the first end and the intermediate portion of the draw member being U-shaped and including parallel, spaced first and second side plates and an interconnecting plate interconnected between the first and second side plates, with the first and second side plates being slideably received between the first and second sidewalls, with the first and second side plates including aligned second pin holes, and with another pin extending through the first pin holes of the bracket and slideably extending through the second pin holes of the draw member and forming the pivot axis of the draw member.

8. The door lock as claimed in claim 7, with the guide slot being formed in the first side plate, with the second side plate including another guide slot aligned with the guide slot, with the first end of the linking rod including parallel, spaced first and second beams extending parallel to and on opposite sides of the longitudinal axis of the linking rod, with the first end of the linking rod further including a plate interconnected between the first and second beams and perpendicular to the longitudinal axis of the linking rod, with the plate having a hole, with the slot being formed in the first beam, with the second beam including another slot aligned with the slot, with the pin extending through the two slots of the linking rod and the two guide slots of the draw member, with the first and second beams of the linking rod being movably received between the first and second sidewalls of the bracket, with the first and second side plates of the draw member being movably received between the first and second side beams, and with the draw member pivoting about the pivot axis when the pin slides along the first and second guide slots of the draw member.

9. The door lock as claimed in claim 8, with the first and second side plates of the draw member including opposite first and second openings extending therebetween, with the follower being movably received between the first and second plates, with the follower including a follower body having a third pin hole extending perpendicularly to the longitudinal axis of the linking rod, with the pin extending through the third pin hole of the follower body, with the follower further including an extension extending from the follower body along the longitudinal axis of the linking rod through the second opening of the draw member, with the extension having a screw hole, with the adjusting member including a threaded shank extending through the hole of the plate into the screw hole of the extension such that rotation of the threaded shank causes movement of the follower along the longitudinal axis of the linking rod and movement of the pin along the two guide slots of the draw member, adjusting the position of the second end of the draw member relative to the retractor.

10. The door lock as claimed in claim 9, with the plate further including a plurality of angularly spaced positioning holes surrounding the hole of the plate, with the adjusting member including a head having an inner side from which the threaded shank extends, with the inner side of the head including a first protrusion releasably engaged with one of the plurality of positioning holes to position the adjusting member relative to the follower, and with the head of the adjusting member being adapted to be driven by a tool to rotate the threaded shank.

11. The door lock as claimed in claim 10, with the inner side of the head further including a plurality of second protrusions angularly spaced from each other and angularly spaced from the first protrusion, with the first and second protrusions being releasably engaged with the plurality of positioning holes to position the adjusting member relative to the follower.

12. The door lock as claimed in claim 11, further comprising, in combination: a spring mounted around the extension of the follower and between the follower body and the plate, with the spring biasing the follower away from the plate and biasing the first protrusion and the plurality of second protrusions to engage with the plurality of positioning holes, and with the first protrusion and the plurality of second protrusions being disengaged from the plurality of positioning holes when a rotational force is applied to the head and compresses the spring.

13. The door lock as claimed in claim 12, with the first and second sidewalls of the bracket including two aligned holes, with the linking rod including a limiting slot aligned with the two holes of the first and second sidewalls, with the door lock further comprising, in combination: a third pin extending through the two holes of the first and second sidewalls and the limiting slot of the linking rod, and with the limiting slot including two ends limiting movement of the third pin to limit movement of the linking rod relative to the bracket.

14. The door lock as claimed in claim 13, with the case including a third slot in a side thereof, with the door including an opening aligned with the third slot, with the door lock further comprising, in combination: a base adapted to be fixed to a side of the door, with the base including a through-hole adapted to be aligned with the opening of the door, with the first and second sidewalls of the bracket being fixed to the base, and with the second end of the draw member slideably extending through the through-hole of the base, the opening of the door, and the third slot of the case.

* * * * *